US006386936B1

(12) United States Patent
Gebara

(10) Patent No.: US 6,386,936 B1
(45) Date of Patent: May 14, 2002

(54) BUILDING BLOCK SET

(76) Inventor: Philippe Gebara, 130 Barrow St. Apt. 310, New York, NY (US) 10014

( * ) Notice: Subject to any disclaimer, the term of this patent is extended or adjusted under 35 U.S.C. 154(b) by 0 days.

(21) Appl. No.: 09/567,171

(22) Filed: May 8, 2000

(51) Int. Cl.[7] ..... A63H 33/08
(52) U.S. Cl. ..... 446/117; 446/124
(58) Field of Search ..... 446/69, 117, 124

(56) References Cited

U.S. PATENT DOCUMENTS

| | | | | | |
|---|---|---|---|---|---|
| 2,425,729 | A | * | 8/1947 | DeSherbinin | 446/124 X |
| 2,440,836 | A | * | 5/1948 | Turngren | 446/124 |
| 4,274,221 | A | * | 6/1981 | Boutet | 446/124 |
| 4,317,654 | A | * | 3/1982 | Wahl | 446/124 X |
| 4,574,960 | A | * | 3/1986 | Shikatani | 446/124 X |
| 4,633,639 | A | | 1/1987 | Deimen | 52/590 |
| 4,699,602 | A | | 10/1987 | Giorgi | 446/124 |
| 4,990,116 | A | | 2/1991 | Chen | 446/124 |
| 5,169,352 | A | * | 12/1992 | Petersen | 446/124 X |
| 5,378,185 | A | | 1/1995 | Ban | 446/124 |
| 5,567,194 | A | | 10/1996 | Stapleton | 446/124 |
| 5,575,120 | A | | 11/1996 | Handley | 52/79.1 |
| 5,928,052 | A | | 7/1999 | Buscher | 446/124 |

FOREIGN PATENT DOCUMENTS

| | | | | |
|---|---|---|---|---|
| DE | 2260228 | * | 6/1973 | 446/124 |
| GB | 11293 | * | 3/1911 | 446/124 |

* cited by examiner

*Primary Examiner*—John A. Ricci
(74) *Attorney, Agent, or Firm*—Steinberg & Raskin, P.C.

(57) ABSTRACT

A block set including a first block having a first and second cubic recess, the first and second cubic recess being diagonally opposed and the convergence points of the first and second cubic recesses being located along a common axis which is arranged a 45° angle relative to each of three orthogonal surfaces that define the first cubic recess and each of three orthogonal surfaces that define the second cubic recess. The block set also including a second cubic block adapted to be at least partially receivable within the first and second recesses of the first block.

18 Claims, 6 Drawing Sheets

FIG. 9
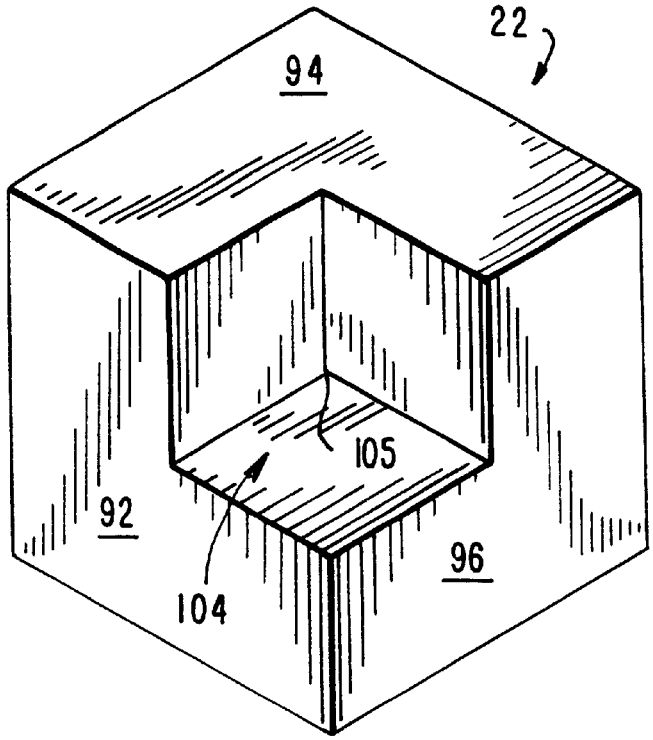
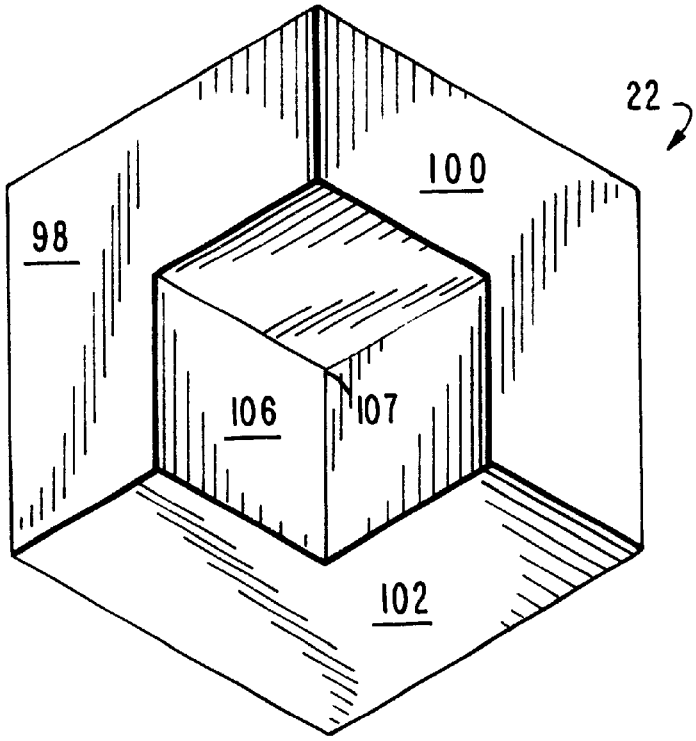
FIG. 10

FIG. 13
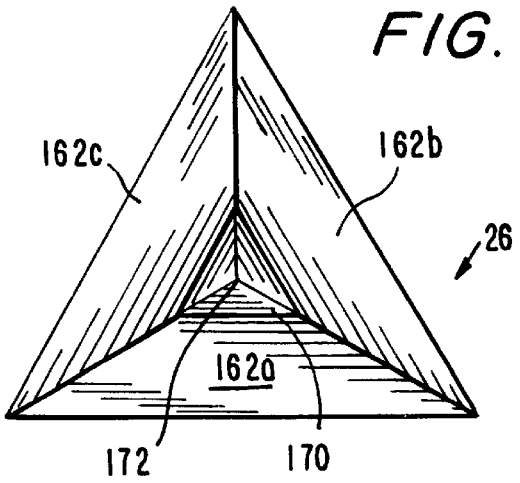
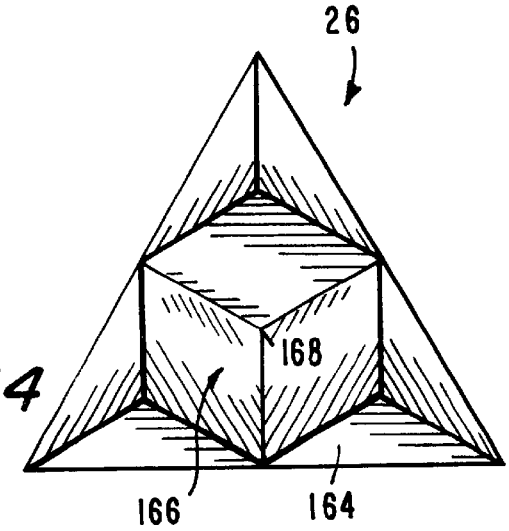
FIG. 14
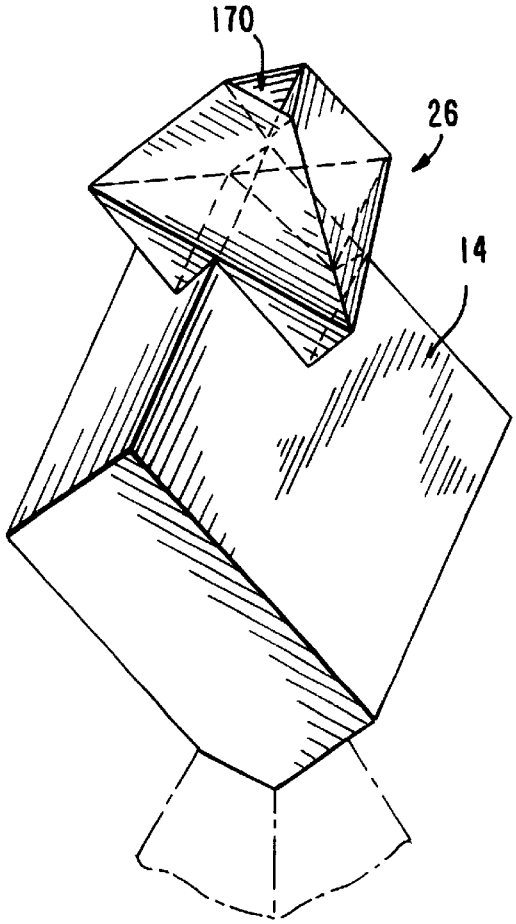
FIG. 15

BUILDING BLOCK SET

FIELD OF THE INVENTION

The present invention relates to toy building blocks, and more particularly to a set of toy building blocks which can be arranged in an inexhaustible array of assemblies, while at the same time requiring the user to assemble the blocks in a selected intellectually challenging fashion.

BACKGROUND OF THE INVENTION

Numerous building blocks sets are known in the prior art. However, the building block sets found in the prior art can, broadly speaking, be divided into one of two categories. The first category includes those sets in which the constituent block elements comprise extremely simple geometric shapes or the like. The second category includes those sets in which the constituent block elements are more complex in nature having multiple protrusions, cutout regions or the like.

Block sets that fall into the first category, i.e. block sets in which the constituent block elements comprise simple geometric shapes or the like, are generally versatile in that the constituent block elements can be arranged in a wide variety of ways to construct an almost limitless number of different assemblies. However, block sets that fall into the first category are also inherently limited in that due to the simplicity of the individual block elements there is no considerable intellectual challenge to the user in assembling the blocks. Furthermore, the structures built using blocks sets of the first category are generally not particularly interesting or ornamental in nature. Perhaps the best example of block sets belonging to the first category are the simple childhood block sets with which we are all familiar, i.e. block sets that merely include a plurality of simple cubic and rectangular block elements. To be sure, block sets of this type may be arranged in an almost limitless number of arrangements. However, as each individual block is simply laid on top of a previously laid block, block sets of this type present relatively no intellectual challenge to user. Furthermore, the structures that result from the assembly of blocks of this type are relatively simple in form and are not particularly appealing to the eye or ornamental in nature.

An example of a block set belonging to the second category is the block set disclosed in U.S. Pat. No. 5,567,194 to Stapleton. The Stapleton patent discloses a block set including a plurality of "multi-faceted nesting modules", that is, a plurality of block elements having a highly complex shape including multiple faces and angles. Block sets of the type disclosed in Stapleton, i.e. block sets belonging in the second category, solve some of the problems discussed above with respect to block sets of the first category, however, they have their own inherent limitations. Certainly, block elements that have a highly complex shape may present an intellectual challenge to the user to the extent that it is difficult to mate one block element with another block element. The structures that result form the assembly of the this complex block elements may be appealing to look at and ornamental in nature. However, due to the highly complex geometry of the individual block elements, blocks sets of the second category are also quite limited in the manner in which one block element may be mated or stacked on another block element. Accordingly, the number of different structures that may be constructed using these types of blocks is likewise limited.

OBJECTS AND SUMMARY OF THE INVENTION

It is therefore an object of the present invention to provide an improved block set that overcomes the limitations of the prior art.

It is another object of the present invention to provide an improved block set that is intellectually stimulating and challenging to the user.

It is another object of the present invention to provide an improved block set in which the individual block elements comprising the block set may be arranged in wide variety of ways to thereby construct an infinite number of different structures.

It is another object of the present invention to provide an improved block set in which the structures generated by the assembly of the individual block elements are visually stimulating and ornamental in nature.

In accordance with the foregoing objectives, the block set according to the present invention comprises a plurality of block elements, the plurality of block elements including at least one block having a first three sided cubic recess defined by a first set of three orthogonally arranged surfaces of the block element and a second three sided cubic recess defined by a second set of three orthogonally arranged surfaces of the block element, the convergence points of the first and second recesses being aligned along a common axis which is arranged at a 45° angle relative to the each of the surfaces defining the first cubic recess and each of the surfaces defining the second cubic recess.

The block set according to the present invention further having at least one rectilinear block element structured and arranged to be at least partially received within the first and second recesses.

BRIEF DESCRIPTION OF THE DRAWINGS

In order that the invention may be clearly understood and readily carried into effect, the preferred embodiments of the invention will now be described, by way of example only, with reference to the accompanying drawings wherein:

FIG. 9 is a perspective view of a fifth block element of the block set according to the present invention;

FIG. 10 is a top view of the fifth block element shown in FIG. 9 in an inclined position showing the opposite side of the block shown in FIG. 9;

FIG. 13 is a bottom perspective view of an eighth block of the block set according to the present invention;

FIG. 14 is a top perspective view of the block element shown in FIG. 13;

FIG. 15 is a perspective view of the eight block element arranged in cooperative relationship with the second block element.

DETAILED DESCRIPTION OF THE INVENTION

Figure 1:
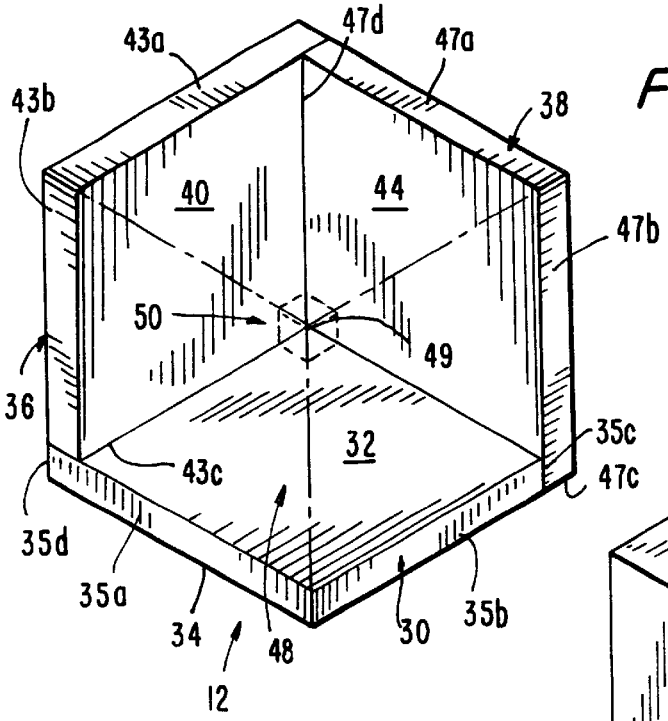
FIG. 1 is a perspective view of a first block element of the block set according to the present invention.

As seen in Figures, the block set according to an embodiment of the present invention comprises a plurality of block elements, selected ones of the plurality of block elements including first and second three sided cubic recesses. The plurality of block elements comprising the illustrated embodiment include a first block element 12 (FIG. 1); a second block element 14 (FIG. 2); a third block element 16 (FIG. 4); a fourth block element 18 (FIG. 6); a fifth block element 22 (FIG. 9); a sixth block element 24*a* (FIG. 11); a seventh block element 25 (FIG. 12) and an eighth block element 26 (FIGS. 13–14). Preferably, the block set according to the present invention includes a plurality of each of block elements 12, 14, 16, 18, 22, 24*a,* 25 and 26.

As shown in FIG. 1, the first block element 12 of the block set according to the present invention comprises a base 30 having an upper surface 32, a lower surface 34 and side surfaces 35*a,* 35*b,* 35*c* and 35*d.* The first block element 12 further comprises first and second vertical walls, 36 and 38, respectively, the first vertical 36 wall having inner and outer surfaces 40 and 42, and side surfaces 43*a,* 43*b,* 43*c* and 43. The second vertical wall 38 includes inner and outer surfaces 44 and 46 and side surfaces 47*a,* 47*b,* 47*c* and 47*d.*

Figure 3:
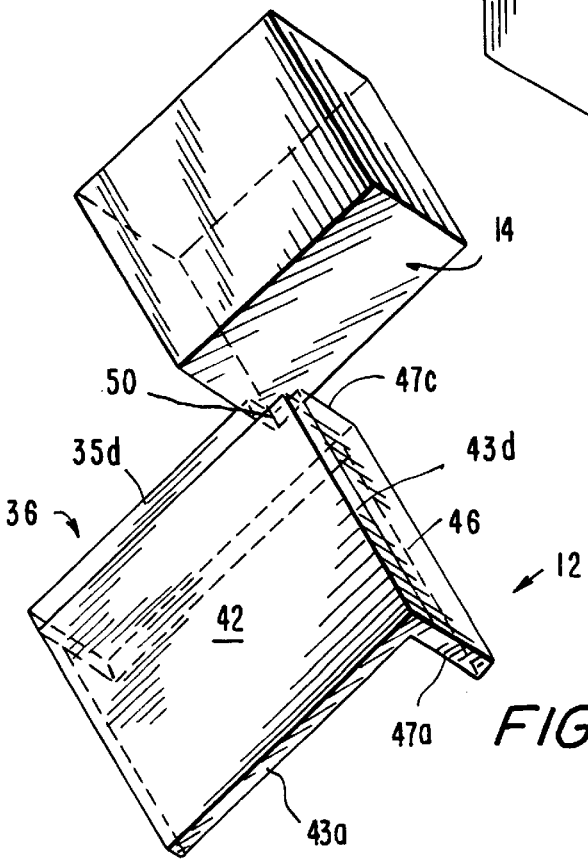
FIG. 3 is a perspective view of the first block element arranged in cooperative relationship with the second block element.

The first and second vertical walls 36 and 38 are arranged orthogonally with respect to the base 30 as well as to each other, with both walls 36 and 38 extending vertically upward from the base 30. The vertical wall 36 is positioned so that side surface 43*c* thereof is arranged in face to face abutment with the upper surface 32 of the base 30 and inner surface 40 thereof is arranged in face to face abutment with side surface 47*d* of vertical wall 38. Further, as best seen in FIG. 3 the vertical wall 36, is arranged so that the outer surface 42 thereof is coplanar with a side surface 35*d* of base 30. Vertical wall 38 is positioned so that inner surface 44 is arranged in face to face abutment with side surface 35*c* of the base 30.

When structured as above, block element 12 defines a three sided cubic recess 48 defined between the inner surfaces 32, 40 and 44 of the base 30, first vertical wall 36 and second vertical wall 38, respectively. The three sided cubic recess 48 is structured and arranged to receive the second block element 14 in the manner shown in (in phantom) FIG. 1.

Figure 2:
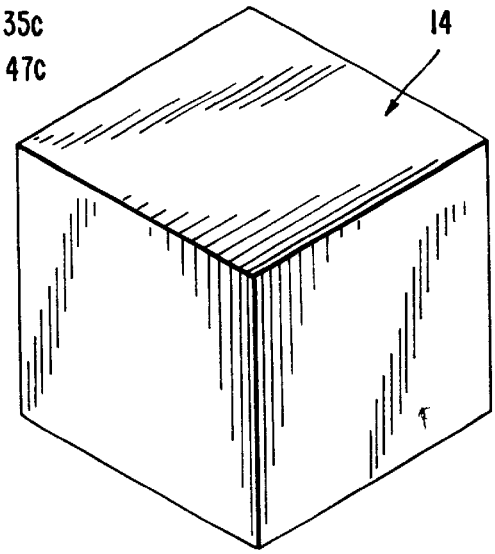
FIG. 2 is a perspective view of a second block element of the block set according to the present invention.

As shown in FIG. 2, the second block element 14 comprises a simple cube structured and arranged to be received within the cubic recess 48.

The first block element 12 further comprises a second three sided cubic recess 50. The second three sided cubic recess 50 is positioned at a comer of the of the base 32, and specifically at the comer of the base 32 where the first vertical wall 36, second vertical wall 38 and base 32 converge. The first and second cubic recesses 48 and 50 are opposed relative to one another, that is, the two recesses open in opposite directions. Further, the second three sided cubic recess 50 is substantially smaller than the first three sided cubic recess 48, the second cubic recess 50 being structured and arranged to receive a comer portion of the second block element 14 in the manner shown in FIG. 3.

The second cubic recess 50 enables the first block element 12 to be arranged by a user in the inverted position shown in FIG. 3 and yet still receive the block element 14. Thus, the first block element 12 may be used in the "standard" fashion shown in FIG. 1 or in the "inverted" position shown in FIG. 3 thereby adding versatility to the block set of the present invention. Further, when placed in the "inverted" position shown in FIG. 3, block element 12 is particularly useful as a base (i.e. first block laid when building a block structure).

It is noted that the first three sided cubic recess 48 and the second three sided cubic recess 50 are diagonally opposed. That is, the first three sided cubic recess 48 is "open" in a first direction and second three sided cubic recess is "open" in a second direction which is diagonally opposed to the first direction. Stated another way, the convergence point 49 of recess 48, i.e. the point where the three sides defining the recess converge, is located along a common diagonal axis as the convergence point 51 of recess 50. It is also noted that the common diagonal axis along which the convergence points 51 and 49 are located is arranged at a 45° angle relative to the each of three orthogonal surfaces that define the recess 48 (i.e., surfaces 40, 44 and 49) and the each of three orthogonal surfaces that define recess 50.

Figure 4:
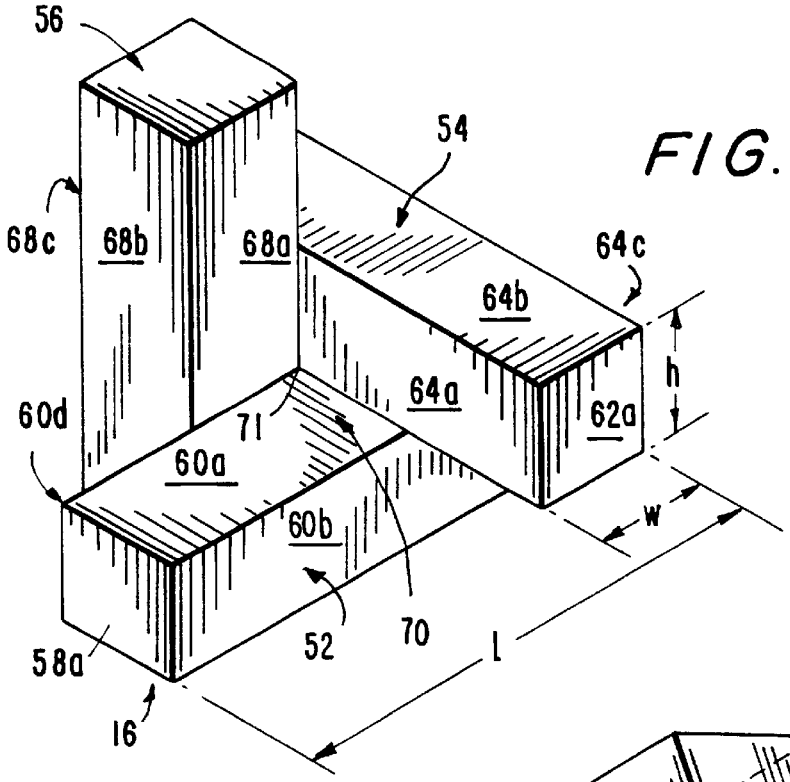
FIG. 4 is a perspective view of a third block element of the block set according to the present invention.
Figure 5:
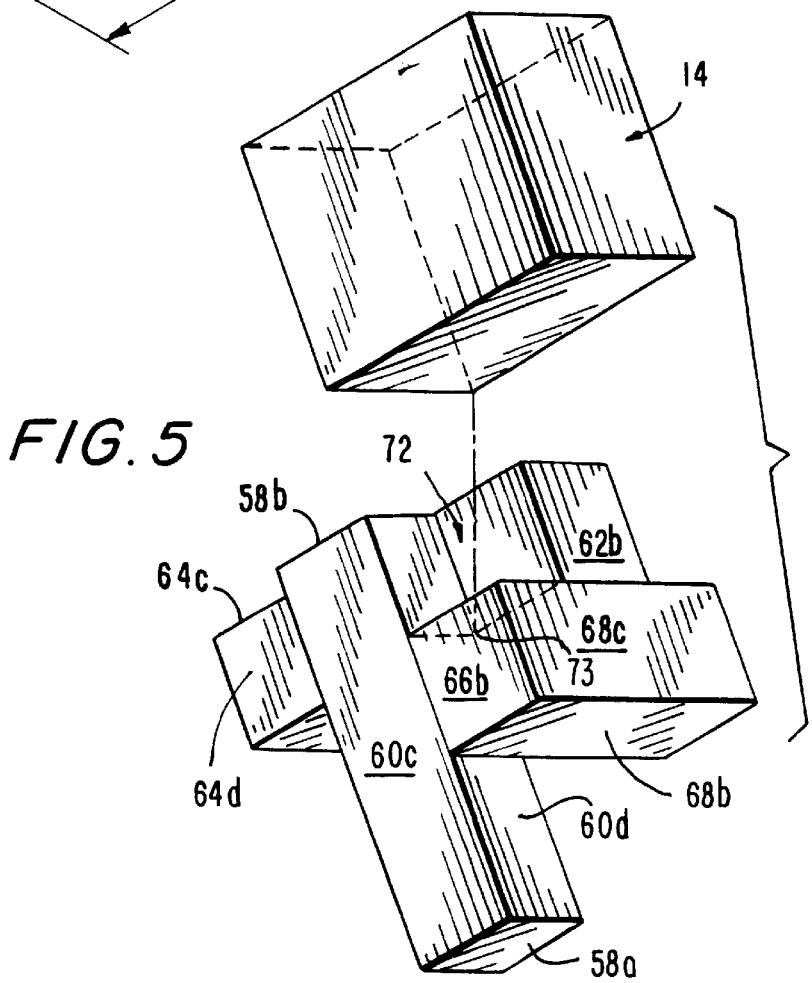
FIG. 5 is a perspective view of the third block element shown in FIG. 4 arranged in an inverted position showing the second block element in cooperative relationship therewith.

Referring to FIGS. 4 and 5, the third block element 16 of the block set according the present invention comprises a first parallelepiped member 52, a second parallelepiped member 54 and a third parallelepiped member 56. The first parallelepiped member 52 including end surfaces 58*a* and 58*b* and side surfaces 60*a,* 60*b,* 60*c* and 60*d;* the second parallelepiped member 54 including end surfaces 62*a* and 62*b* and side surfaces 64*a,* 64*b,* 64*c* and 64*d;* and the third parallelepiped member 56 including end surfaces 66*a* and 66*b* and side surfaces 68*a,* 68*b,* 68*c* and 68*d.* Preferably each of the members 52, 54 and 56 have equal lengths "l" and heights "h". In addition, each of the members 52, 54 and 56 preferably have a width "w" which is equal to one third of the total length "l".

For purposes of clarity the relative positional relationships of the first 52, second 54 and third 56 parallelepiped members will be described with reference to FIG. 4 only. As shown in FIG. 4, the first member 52 is arranged in a horizontal fashion and the second member 54 is arranged orthogonally relative to first member in the manner shown. Specifically, the second member 54 is arranged horizontally on top of the first member so that side surface 60*a* of the first member 52 is arranged in face to face abutment with the side surface 64*d* of the second member 54. Further, the second member 54 is arranged at one end of the first member 52 such that the side surface 64*c* of the second member 54 is coplanar with the end surface 58*b* of the first member 52.

The third member 56 is arranged in a vertical fashion with respect to horizontal members 52 and 54 and is placed at an intermediate position along the length of the first member 52. Specifically, member 56 is arranged so that one third of the total length "l" of member 52 extends beyond surfaces 68*b* and 68*d* of member 56. Similarly, member 54 is arranged on top of member 52 so that one third of the total length of member 54 extends beyond surface 60*b* and 60*d* of member 52.

Further, the third member 56 is arranged with its side surface 66*d* abutting and being coplanar with side surface 60*c* of the first member 52 and with its side surface 68*d* abutting and being coplanar with side surface 64*a* of the second member. Finally, the third member 52 is arranged so that its end surface 66*b* is coplanar with side surface 60*c* of the first member 52.

The structure and arrangement of the third block element 16 as defined above results in the third block element 16 including a first three sided cubic recess 70 and a second three sided cubic recess 72 (FIG. 5). The three sided cubic recess 70 is structured and arrange to receive block element 14 in a similar manner as described with regard to block element 12 and with reference to FIG. 1. Alternatively, the third member may be inverted in the fashion shown in FIG. 5. When positioned in this fashion, the block element 14 can be arranged in recess 72 as shown. The block element 16 will thus cooperate with block element 14 when it is in either the "standard" position shown in FIG. 4 or in the "inverted" position shown in FIG. 5.

It is noted that the first three sided cubic recess 70 and the second three side cubic recess 72 are arranged in diagonally opposed relationship to one another. That is, the convergence point 71 of recess 70 and the convergence point 73 of recess 72 are arranged along a common diagonal axis, with each of the cubic recesses being "open" in opposite directions along that axis. In addition, it is noted that the diagonal axis that passes through the convergence points 71 and 73 is located 45° from each of the three orthogonally arranged surfaces that define recess 70 and 45° from each of three orthogonally arranged surfaces that define recess 72. For example, with respect to recess 70, the axis passing through convergence points 71 and 73 is 45° from surfaces 64*a*, 68*a* and 60*a*.

The third block element 16 is structured and arranged to fit within the three sided cubic recess 48 of the first block element 12. That is, when the third block element 16 is in its "standard" position shown in FIG. 4 it may be placed within recess 48 of the first block element 12 as long as the convergence points of the recess 70 and 72 are arranged so that they lie along the same axis as the convergence points of recesses 48 and 50.

Figure 6:
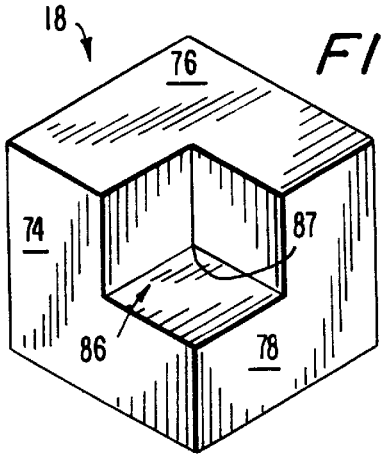
FIG. 6 is a perspective view of a fourth block element of the block set according to the present invention.
Figure 7:
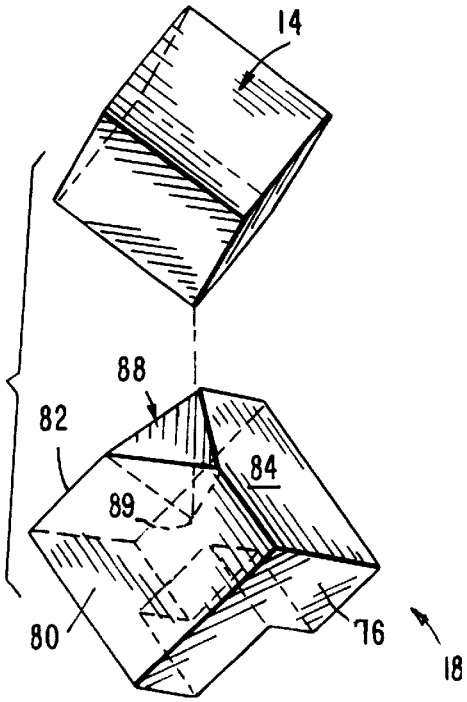
FIG. 7 is a perspective view of a the fourth block element shown in FIG. 6 arranged in an inverted position showing the second block element being inserted into the pyramidal recess thereof.
Figure 8:
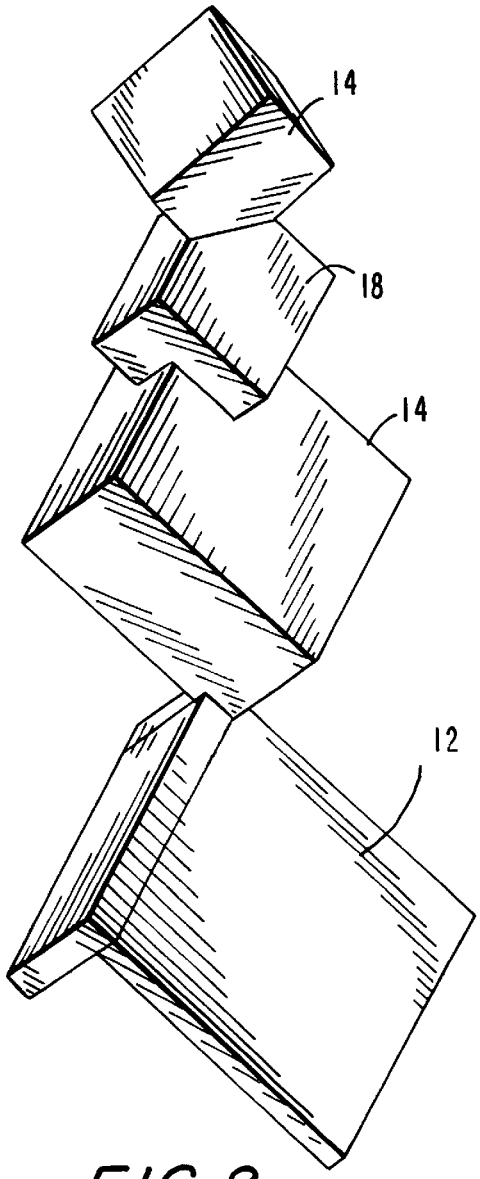
FIG. 8 is a perspective view of a plurality of the blocks of the block set according to the present invention arranged to form a block structure.

The fourth block element 18 of the present invention will be described with reference to FIGS. 6 and 7. The fourth block element 18 comprises a hexagon having three identical L-shaped faces, 74, 76 and 78, and three identical pentagonal faces 80, 82 and 84. As shown in FIG. 6, the three L-shaped faces cooperate to define a three sided cubic recess 86. As shown in FIG. 7, the three pentagonal faces 80, 82 and 84 cooperate to define a pyramidal three sided recess 88. The internal surfaces that define recess 88 comprise three isosceles triangle surfaces, with the ninety degree angle of each triangle being proximate to the convergence point 89 of the recess. In this way, the three triangular internal surfaces defining the recess 88 are arranged ninety degrees relative to one another and thus the recess 88 is structured and arranged receive a comer portion of the cube 14 as shown in FIG. 7. Again, it is noted that the convergence point 87 of recess 86 lies along the same diagonal axis as the convergence point 89 of recess 88.

When block element 18 is in the position shown in FIG. 6 it may receive block element 14 in recess 86. However, recess 86 may also receive block element 12 and block element 16 as long as these elements are arranged in the recess 86 so that the convergence points of the recesses in these blocks (i.e. 48 and 50, 70 and 72) are arranged along the same axis along which the convergence points of recesses 86 and 88 are located.

Block element 18 may also be used in the inverted position shown in FIG. 7 in which case recess 88 can receive a corner portion of the cubic block element 14 as shown.

The fifth block element 22 of the present invention will be described with reference to FIGS. 9 and 10. As shown, the fifth block element 22 comprises a hexagon having six identical L-shaped sides 92, 94, 96, 98, 100 and 102. Sides 92, 94 and 96 cooperate to define a three sided cubic recess 104 as shown. Sides 98, 100 and 102 cooperate to define another three sided cubic recess 106 which is of identical size to recess 102. The convergence points 105 and 107 of recesses 104 and 106 are located along the same diagonal axis with the recesses being open along opposite directions of the axis. Moreover, the diagonal axis that passes through convergence points 105 and 107 is arranged at a 45° angle relative to the three orthogonal surfaces that define recess 104 (i.e. 97*a*, 97*b* and 97*c*) and the second set of three orthogonal surfaces that define recess 106. Although the fifth block element 22 is depicted in the figures as being generally cubic in shape it is appreciated that the block element 22 could be structured to be generally rectangular in shape as long as the block includes two cubic recesses as described above.

Block element 22 may be utilized in the "flat" position shown in FIGS. 9 or may be utilized in an "inclined" fashion shown in FIG. 10. That is, block element may be rotated so that the axis passing through the convergence points of recesses 104 and 106 line is vertical. In this state, the block 22 can be placed on a flat surface as the first block of a structure to be built. In a block structure already in process, the block 22 may be placed on top of a cubic element 14 inclined in like fashion.

The sixth block 24*a* of the block set according to the present invention will be described with reference to FIG. 11.

Block element 24*a* comprises a base 108*a* having an upper surface 110*a*, a lower surface 112*a* and side surfaces 114*a*, 116*a*, 118*a* and 120*a*. Block element 24*a* further comprises first and second vertical walls, 122*a* and 124*a* respectively, the first vertical wall 122*a* having inner and outer surfaces 126*a* and 128*a*, and side surfaces 130*a*, 132*a*, 134*a* and 136*a*. Preferably base 108*a* and first and second vertical walls 122*a* and 124*b* comprise identically dimensioned squares elements each having a thickness "t".

The second vertical wall 124*a* includes inner and outer surfaces 138*a* and 140*a*, and side surfaces 142*a*, 144*a*, 146*a* and 148*a*. The first and second vertical walls 122*a* and 124*a* are arranged orthogonally with respect to the base as well as to each other, with both walls 122*a* and 124*a* extending upwardly with respect to the base 108*a*

Figures 11, 12:
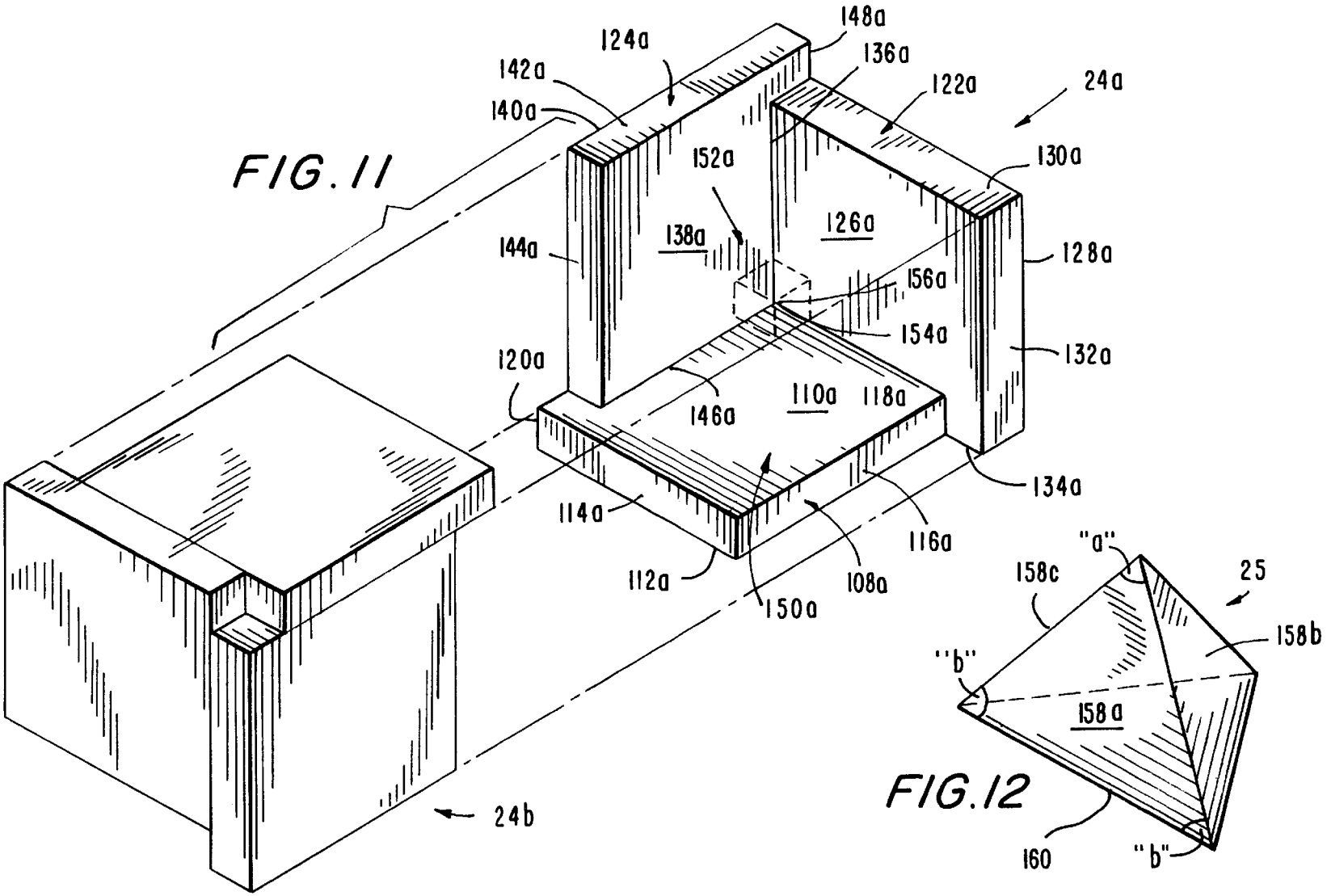
FIG. 11 is a perspective view of a sixth block element of the block set according to the present invention together with a variation of the sixth block element which consists of a mirror image thereof.
FIG. 12 is a perspective view of a seventh block element of the block set according to the present invention.

As shown in FIG. 11, the first vertical wall 122*a* is mounted to the base 108*a* so that the inner surface 126*a* thereof is in face to face abutment with side surface 118*a* of the base 108*a*. The vertical wall 122*a* is mounted in offset relationship to the base so that a portion of the wall extends beyond side surface 116*a* of the base 108*a*. Preferably the length of the portion of the wall 122*a* that extends beyond side surface 116*a* is equal to the width "t" as shown.

The second vertical wall 124*a* is mounted to the base 108*a* so that the side surface 146*a* thereof is in face to face abutment with upper surface 110*a* of the base 108*a* and the front surface 138*a* is in face to face abutment with side surface 136*a* of wall 122*a*. Moreover, side surface 148*a* of the second vertical wall 124*a* is coplanar with the outer surface 128*a* of the first vertical wall 126*a*. When mounted in this manner, a portion of the second vertical wall 124*a* extends vertically beyond the side surface 130*a* of the first vertical wall 122*a* and a portion of the base 108*a* extends beyond surface 144*a* of the second vertical wall 124*a*.

Preferably the lengths of all of the portions (i.e. the offset portions of the walls) of walls that extend beyond the surface of a corresponding wall are equal to "t", that is, the thickness of the members used to construct the block element 24*a*.

When constructed as described above the block element 24*a* defines a first three sided cubic recess 150*a* and a second three sided cubic recess 152*a*. Again the convergence points 154*a* and 156*a* of recesses 150*a* and 152*a* lie along the same diagonal axis. In fact, as shown, the convergence points 154*a* and 156*a* are located at the same point. Again, the recesses 150*a* and 152*a* are opposed to one another in that they are "open" in opposite directions along the axis on which the convergence points 154*a* and 156*a* lie. Furthermore, the axis that passes through convergence points 154*a* and 156*a* is located 45° relative to the three orthogonal arranged surfaces that define recess 150*a* and the three orthogonal surfaces that define recess 152*a*. For example, with respect to recess 150*a,* the axis that passes through the convergence points 154*a* and 156*a* is located 45° relative to surfaces 138*a,* 126*a* and 100*a*.

The block set according to the present invention may optionally include block 24*b* as shown in FIG. 11. Block 24*b* is a mirror image of block 24*a* as described above. When blocks 24*a* and 24*b* are constructed so that the offset portions of the members have a length equal to the thickness "t", the blocks 24*a* and 24*b* can be mated in the fashion shown in FIG. 11.

The seventh block element 25 of the block set according to the present invention is shown in FIG. 12. The block element 25 generally comprises a pyramidal body having three identical triangular side surfaces 158*a,* 158*b* and 158*c* and a triangular base 160. Each of the triangular side surfaces 158*a,* 158*b* and 158*c* are defined by a right angle "a" located near the apex of the pyramid and two forty five degree angles "b" located near the base of the pyramid. In this manner, three side surfaces 158*a,* 158*b* and 158*c* are arranged so that they are positioned ninety degrees relative to one another.

The seventh block element 25 is primarily intended to be used as a "starter block" when using the block set according the present invention. For example, when beginning a structure, a user might first place the seventh block element on a flat surface with the base 160 abutting the flat surface. Then, the user might take, for example, block element 16 and arrange block element 16 on top of the seventh block element 25 so that the apex of block element 25 is inserted within three sided cubic recess 70. Alternatively, the user might arrange block element 16 so that the apex of block element 25 is inserted within recess 72 of block element 16. In this way, the user may use the seventh block element 25 to begin a block structure being built.

The eighth block 26 of the block set according to the present invention is shown in FIGS. 13 and 14. As shown, the eighth block 26 comprises a pyramidal body having identical triangular side surfaces 162*a,* 162*b,* 162*c* and a triangular base 164. Each of the side surfaces 162*a,* 162*b* and 162 comprise isosceles triangles having a ninety degree angle located proximate to the apex of the triangular body of the block 26. As shown in FIG. 14, the base 164 of block element 26 is provided with a three sided cubic recess 166. The three sided cubic recess 166 is arranged in the base 164 so that the convergence point 168 of the recess is collinear with the apex of the block 26. Specifically, the convergence point 168 of the recess is vertically aligned with the apex of block 26. As shown in FIG. 14, the surfaces of the base 164 may be optionally tapered in the fashion shown. In use, the block element 26 may be arranged on top of a cubic block element 14 in the manner shown in FIG. 15. That is, the block 26 may be arranged on top of block 14 so that a comer portion of the block 14 is received within recess 166.

As shown in FIG. 13, the block 26 may optionally be provided with a pyramidal recess 170 with a convergence point 172 that is vertically aligned with the convergence point 168 of cubic recess 166.

The examples of the present invention described above are not meant to be exclusive. Many other variations of the present invention would be obvious to those skilled in the art, and are contemplated to be within the scope of the appended claims.

I claim:

1. A block set comprising:

a first block having a body including a first three sided cubic recess defined by a first set of three orthogonally arranged surfaces of said body and a second three sided cubic recess defined by a second set of three surfaces of said body, said first three sided cubic recess having a first convergence point at the intersection of said first set of three orthogonally arranged surfaces and said second cubic recess having a second convergence point at the intersection of said second set of three orthogonally arranged surfaces, each of said first and second convergence points being aligned along a common axis that is arranged at a 45° angle relative to said first set of three orthogonally arranged surfaces and said second set of three orthogonally arranged surfaces;

a second block having a rectilinear body structured and arranged to be at least partially receivable within said first and second cubic recesses; and wherein said second three sided cubic recess is substantially smaller relative to said first three sided cubic recess and is structured and arranged to receive a corner portion of said second block element.

2. The block set according to claim 1, wherein said first three sided cubic recess is structured and arranged to open in a first direction along said common axis and said second three sided cubic recess is structured and arranged to open in a second direction along said common axis.

3. The block set according to claim 1, wherein first block element comprises a planar base and first and second vertical walls arranged orthogonally with respect to said base and extending vertically upward relative thereto, said first and second vertical walls being arranged orthogonally with respect to one another.

4. The block set according to claim 1, wherein said first block comprises six identical L-shaped sides.

5. A block set comprising:

a first block having a body including a first three sided cubic recess defined by a first set of three orthogonally arranged surfaces of said body and a second three sided cubic recess defined by a second set of three surfaces of said body, said first three sided cubic recess having a first convergence point at the intersection of said first set of three orthogonally arranged surfaces and said second cubic recess having a second convergence point at the intersection of said second set of three orthogonally arranged surfaces, each of said first and second convergence points being aligned along a common axis that is arranged at a 45° angle relative to said first set of three orthogonally arranged surfaces and said second set of three orthogonally arranged surfaces;

a second block having a rectilinear body structured and arranged to be at least partially receivable within said first and second cubic recesses; and wherein said first block element comprises a first horizontal parallelepiped member, a second horizontal parallelepiped member arranged on top of said first parallelepiped member and orthogonally thereto and a third parallelepiped member arranged orthogonally and vertically with respect to said first and second parallelepiped members.

6. The block set according to claim 5, wherein said third parallelepiped is arranged at an intermediate location along a length of said first parallelepiped member.

7. The block set according to claim 6, wherein said second parallelepiped member is arranged on top of said first parallelepiped member at an intermediate location of said second parallelepiped member.

8. The block set according to claim 7, wherein said second parallelepiped member is arranged on top of said first parallelepiped member so that a side surface of said second parallelepiped member is coplanar with an end surface of said first parallelepiped member.

9. A block set comprising:

a first block having a body including a first three sided cubic recess defined by a first set of three orthogonally arranged surfaces of said body and a second three sided cubic recess defined by a second set of three surfaces of said body, said first three sided cubic recess having a first convergence point at the intersection of said first set of three orthogonally arranged surfaces and said second cubic recess having a second convergence point at the intersection of said second set of three orthogonally arranged surfaces, each of said first and second convergence points being aligned along a common axis that is arranged at a 45° angle relative to said first set of three orthogonally arranged surfaces and said second set of three orthogonally arranged surfaces;

a second block having a rectilinear body structured and arranged to be at least partially receivable within said first and second cubic recesses; and a third block having a pyramidal recess structured and arranged to receive a corner portion of said second block.

10. The block set according to claim 9, wherein said third block comprises three L-shaped faces and three pentagonal faces.

11. A block set comprising:

a first block having a body including a first three sided cubic recess defined by a first set of three orthogonally arranged surfaces of said body and a second three sided cubic recess defined by a second set of three surfaces of said body, said first three sided cubic recess having a first convergence point at the intersection of said first set of three orthogonally arranged surfaces and said second cubic recess having a second convergence point at the intersection of said second set of three orthogonally arranged surfaces, each of said first and second convergence points being aligned along a common axis that is arranged at a 45° angle relative to said first set of three orthogonally arranged surfaces and said second set of three orthogonally arranged surfaces;

a second block having a rectilinear body structured and arranged to be at least partially receivable within said first and second cubic recesses;

a third block having three L-shaped faces and three pentagonal faces, said three L-shaped faces cooperating to define a third three sided cubic recess and said three pentagonal faces cooperating to define a pyramidal three sided recess.

12. The block set according to claim 11, wherein said third three sided cubic recess is structured and arranged to receive at least a portion of said second block.

13. The block set according to claim 11, wherein said pyramidal recess is structured and arranged to receive at least a portion of said second block.

14. A block set comprising:

a first block having a body including a first three sided cubic recess defined by a first set of three orthogonally arranged surfaces of said body and a second three sided cubic recess defined by a second set of three surfaces of said body, said first three sided cubic recess having a first convergence point at the intersection of said first set of three orthogonally arranged surfaces and said second cubic recess having a second convergence point at the intersection of said second set of three orthogonally arranged surfaces, each of said first and second convergence points being aligned along a common axis that is arranged at a 45° angle relative to said first set of three orthogonally arranged surfaces and said second set of three orthogonally arranged surfaces;

a second block having a rectilinear body structured and arranged to be at least partially receivable within said first and second cubic recesses;

wherein said first block comprises a horizontal base, a first vertical wall arranged orthogonally with respect to said base and a second vertical wall arrange orthogonally to said first vertical wall and said base, wherein said base includes an offset portion that extends horizontally beyond a first side surface of said second vertical wall, said second vertical wall having an offset portion that extends vertically beyond an upper side surface of said first vertical wall, and said first vertical having an offset portion that extends horizontally beyond another side surface of said base.

15. A block set comprising:

a first block having a body including a first three sided cubic recess defined by a first set of three orthogonally arranged surfaces of said body and a second three sided cubic recess defined by a second set of three surfaces of said body, said first three sided cubic recess having a first convergence point at the intersection of said first set of three orthogonally arranged surfaces and said second cubic recess having a second convergence point at the intersection of said second set of three orthogonally arranged surfaces, each of said first and second convergence points being aligned along a common axis that is arranged at a 45° angle relative to said first set of three orthogonally arranged surfaces and said second set of three orthogonally arranged surfaces;

a second block having a rectilinear body structured and arranged to be at least partially receivable within said first and second cubic recesses; and a third block having a pyramidal body including three identical triangular side surfaces and a triangular base.

16. The block set according to claim 15, wherein each of said identical triangular side surfaces include a right angle located proximate to an apex of said pyrmidal body.

17. A block set comprising:

a first block having a body including a first three sided cubic recess defined by a first set of three orthogonally arranged surfaces of said body and a second three sided cubic recess defined by a second set of three surfaces of said body, said first three sided cubic recess having a first convergence point at the intersection of said first set of three orthogonally arranged surfaces and said second cubic recess having a second convergence point at the intersection of said second set of three orthogonally arranged surfaces, each of said first and second convergence points being aligned along a common axis that is arranged at a 45° angle relative to said first set of three orthogonally arranged surfaces and said second set of three orthogonally arranged surfaces;

a second block having a rectilinear body structured and arranged to be at least partially receivable within said first and second cubic recesses; and a third block having pyramidal body having three identical triangular side surfaces and a triangular base, said base having a third three sided cubic recess therein.

18. The block set according to claim 17, wherein said third block further comprises a pyramidal recess arranged in an apex of said third block.

* * * * *